United States Patent [19]

Mahieu et al.

[11] 4,220,941

[45] Sep. 2, 1980

[54] HIGH CONTINUOUS CURRENT CAPACITY OIL EXPULSION FUSE HAVING MULTIPLE, UNIDIRECTIONALLY VENTED, SEALED BORES

[75] Inventors: William R. Mahieu; Charles A. Popeck, both of Centralia, Mo.

[73] Assignee: A. B. Chance Company, Centralia, Mo.

[21] Appl. No.: 951,108

[22] Filed: Oct. 13, 1978

[51] Int. Cl.[2] ..... H01H 85/14; H01H 85/02

[52] U.S. Cl. ..... 337/250; 337/204; 337/249

[58] Field of Search ..... 337/250, 278, 279, 280, 337/229, 237, 246, 249, 281, 282, 203, 204

[56] References Cited

U.S. PATENT DOCUMENTS

| | | | |
|---|---|---|---|
| 2,156,058 | 4/1939 | Lohausen | 337/249 |
| 2,291,341 | 7/1942 | Lincks | 337/249 |
| 4,041,434 | 8/1977 | Jacobs et al. | 337/204 |

*Primary Examiner*—Harold Broome

*Attorney, Agent, or Firm*—Schmidt, Johnson, Hovey & Williams

[57] ABSTRACT

A high voltage oil expulsion fuse having multiple fuse wire bores which vent into opposed chambers which communicate with the oil medium for convective flow of oil through the bores during normal operation is provided wherein a pressure sensitive valve associated with one of the chambers allows only unidirectional venting of deionizing gases from the fuse when a fault or overload occurs causing sequential melting of the fusible elements in respective bores. Oil derived gases generated by the last to melt fusible element vent in both directions from the corresponding bore and the pressure thereof causes the valve to close forcing such gases to flow through the remaining bores to assure complete evacuation of conductive material from all bores upon fuse operation. In this manner, interruption against a high rate of rise of recovery voltage is assured and delayed failure of the fuse under normal frequency recovery voltage is also prevented. Only a partial segment of each fuse wire is fusible while the remainder is configured to enhance complete evacuation of conductive material from the bores by oil-derived arc generated gases upon operation of the fuse. The fuse wire bores are formed in a cylindrical dielectric core which in turn is contained within a tubular casing that supports the terminals of the fuse in spaced relation. Strategically positioned seals are provided to preclude gas leakage from the bores into the interface between the core and the casing such that dielectric breakdown in this area is prevented.

15 Claims, 9 Drawing Figures

HIGH CONTINUOUS CURRENT CAPACITY OIL EXPULSION FUSE HAVING MULTIPLE, UNIDIRECTIONALLY VENTED, SEALED BORES

TECHNICAL FIELD

This invention relates to oil-immersed electrical fusing devices in general, and is particularly concerned with improvements in multiple bore oil expulsion fuses which provide greater fault interrupting capability than similarly rated single bore fuses designed for use in high voltage applications.

BACKGROUND ART

Oil expulsion fuses have long been used by utility companies and others as a mainstay device in electrical distribution circuits to protect transformers and similar equipment against damage from fault and overload currents. Such uses typically comprise an open ended, single bore, tubular fuse cartridge interposed between a pair of spaced conductor end terminal caps and adapted to receive an expendable fuse link comprising an elongated fusible element contained within an auxiliary arc tube. When a fault or overload current is experienced in a circuit provided with such a fuse, the fusible element melts, causing arcing to occur within the auxiliary tube between the severed segments of the fusible element. Heat which is produced by the arc vaporizes oil contained in the bore of the tube thereby producing pressurized deionizing gas which vents at opposite ends of the fuse cartridge. As the venting gases produced by the arc flow toward respective ends of the tube they serve not only to cool and deionize the latter such that it is effectively extinguished but also expel solid materials from the bore which could tend to sustain the arc. A particularly important requirement is prevention of arc restrike.

Although oil expulsion fuses have proven satisfactory in many applications, it has been found that conventional design fuses are not entirely satisfactory, especially for use in high voltage distribution circuits in the 25 to 35 KV range or higher. Certain of the problems associated with conventional oil expulsion fuses in high voltage applications are explained in some detail in an application for U.S. Letters Patent of the same assignee filed on even date herewith and comprising a continuation-in-part of application Ser. No. 837,922 filed Sept. 29, 1977. In addition to explaining the drawbacks of prior art fuses, the referenced application discloses a novel multiple-bored oil expulsion fuse particularly adapted to provide high continuous current capabilities without sacrificing interrupt reliability.

In the specification and drawing of the above identified continuation-in-part application there is illustrated an oil expulsion fuse having three discrete fuse bores each provided with a separate fuse element. That invention is predicated on the discovery that fuses having higher continuous current ratings (ampacity) could be designed utilizing the principles of multiple bore construction if means is provided to insure greater flow of arc extinguishing gases from one end of the fuse than the other. However, efforts to accomplish higher ampacity fuses by utilizing a greater number of bores met with somewhat less than desired success for higher voltages. In this regard, such fuses would interrupt a fault current against a high rate of rise of recovery voltage (up to 2,000 volts per microsecond) in a desired manner, but would sometimes fail to withstand the normal frequency recovery voltage encountered after the initial arc in the fuse had been extinguished. As a consequence, the possibility existed of an arc being reestablished in the fuse thereby resulting in a failure of the fuse to interrupt the fault.

This arc restrike problem with multiple-bored expulsion fuses having more than three bores is believed to be the result of residual fuse element material left in the bores after the initial arc in the fuse has been extinguished. In conventional design expulsion fuses having a single arc chamber, the high pressure gases generated upon arcing in the chamber serve to expel substantially all remaining portions of the fuse element to preclude restriking in the chamber after the initial arc is extinguished. It is believed that the venting gas flow in the fuses having many discrete bores is simply not sufficient to properly clean the bores even when gas flow from one end of the fuse is restricted to a greater extent than outflow from the opposite extremity thereof.

DISCLOSURE OF INVENTION

The present invention overcomes the problems discussed hereinabove by the provision of a many-bored oil expulsion fuse having a unique pressure controlled valve to assure unidirectional venting from the fuse when a fault or overload current is experienced across the fuse. The valve is normally in an open position to allow convective cooling oil to flow through the fuse bores via natural draft such that heat generated in the fuse elements under normal current loads is properly dissipated. When the fuse is subjected to an overload or fault current, the inherently weakest fuse link element melts first and the current is then carried by the remaining parallel connected fuse link elements. An arc is thus finally generated in the fuse bore of the last to melt fuse element producing deionizing gases from vaporization of oil contained in such bore and causing the gases to flow outwardly in opposite directions toward the common vent chambers provided at corresponding ends of the multiple bored fuse member. Gases directed into the non-valved chamber are exhausted into the oil surrounding the fuse. However, gases entering the valved chamber effect closing of the valve when the pressure builds up to a predetermined magnitude. Closing off of the valved chamber from the surrounding oil forces gases collecting therein to flow through all of the non-arcing fuse bores in only one direction. This unidirectional venting of the non-arcing bores effects improved cleaning thereof such that subsequent restrikes are virtually eliminated.

Additionally, and in furtherance of the unidirectional venting feature of the present invention, there is provided an improved seal between the bore defining core and the dielectric outer casing of the fuse at the end associated with the pressure operated valve. This seal precludes migration of the dionizing gases from the closed end of the fuse into the interface between the core and the insulating casing. Hence, the possibility of arc formation is precluded between the fuse terminals outside of the fuse link receiving bores.

Additionally, the present invention contemplates the utilization of uniquely designed fuse elements to be disposed within respective fuse tube bores therefor, such that the location of melting and arc formation along the elements occurs adjacent the end of the fuse associated with the vent controlling valve. In this connection, each element has a lower fusible segment and an upper nonfusible, axially twisted conductive ribbon. Since the venting occurs unidirectionally upwardly, the construction of the fuse elements assures that the major portion of each element will always be blown from the fuse upon arcing in one of the bores.

BEST MODE FOR CARRYING OUT THE INVENTION

Figure 1:
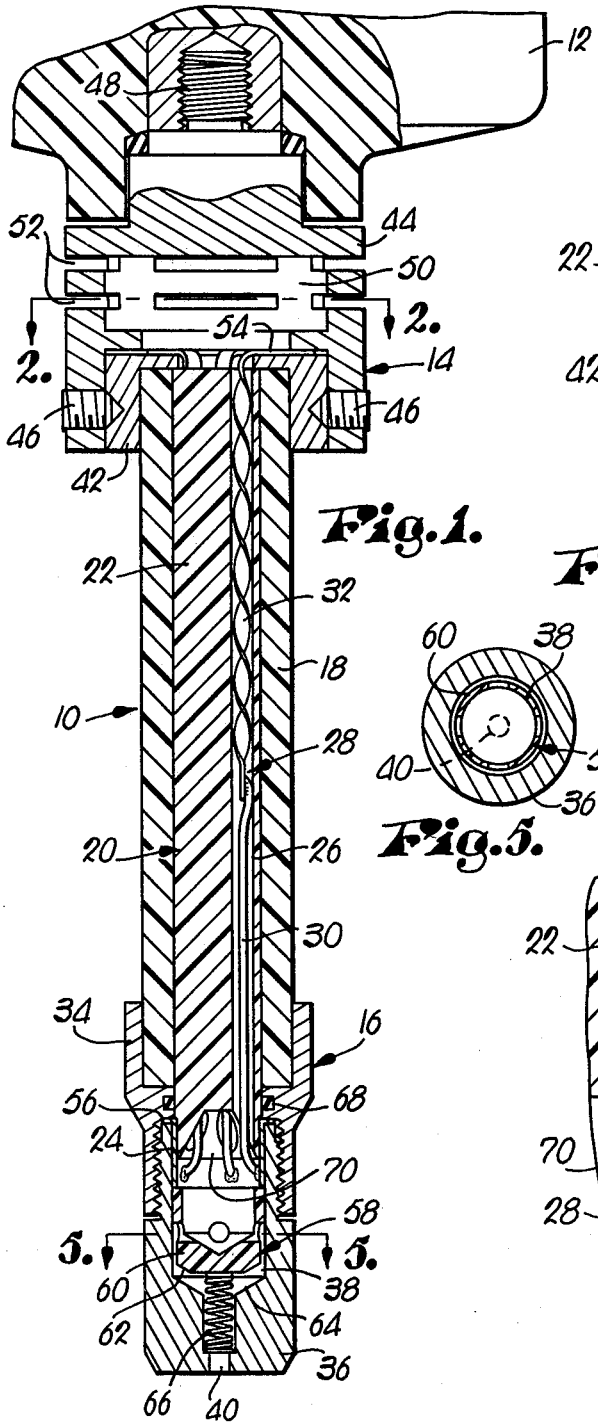
FIG. 1 is a longitudinal cross-sectional view of a fuse constructed in accordance with the principles of the present invention.

FIG. 1 of the drawings illustrates a multiple-bored oil expulsion fuse 10 coupled in end-to-end alignment with a current limiting fuse 12 (only partially illustrated). The fuse 10 is adapted to protect an electrical device such as a distribution transformer or switching unit and is intended to be submersed within a reservoir of transformer oil or other dielectric fluid.

The fuse 10 comprises a pair of spaced, electrically conductive end caps 14 and 16; a nonconductive tubular fuse cartridge 18 holding the caps 14, 16 in spaced relations; and an expulsion fuse link 20 complementally received within the tubular cartridge 18 and electrically interconnecting the caps 14, 16. As will be explained later, both of the caps 14, 16 are of two piece construction to permit replacement of the fuse link 20 after operation of the fuse 10.

Figure 2:
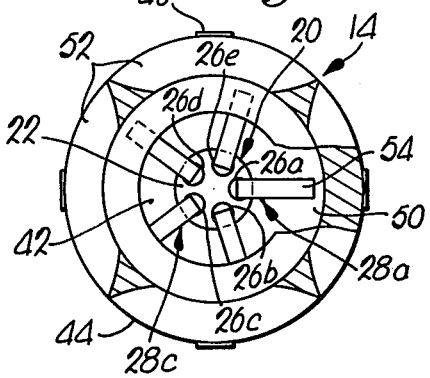
FIG. 2 is an enlarged, cross-sectional view taken along line 2—2 of FIG. 1 and having portions thereof broken away for clarity.
Figure 3:
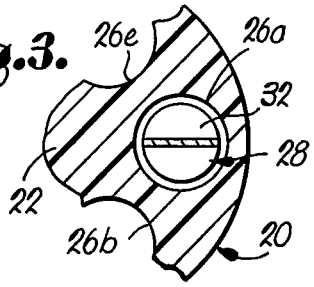
FIG. 3 is an enlarged, fragmentary, transverse cross-sectional view of the fuse showing the non-fusible section of one fuse element disposed within its respective bore.
Figure 5:
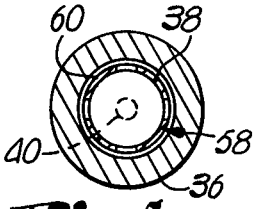
FIG. 5 is a cross-sectional view taken along line 5—5 of FIG. 1.

The fuse link 20 comprises an elongated, cylindrical, synthetic resin insert member 22 having a tubular metal contact 24 supported telescopically on one end thereof. In the preferred embodiment, five uniform diameter cylindrical bores 26*a*, 26*b*, 26*c*, 26*d*, and 26*e* are formed in the member 22 and extend axially thereof along its full length. As shown for example in FIG. 2, the bores 26 are clustered symmetrically around the longitudinal axis of the member 22. The link 20 is also provided with five fuse link elements 28*a*, 28*b*, 28*c*, 28*d* and 28*e* each disposed within a respective one of the bores 26 as shown for example in FIG. 1. Each of the elements 28 comprises a fusible segment 30 soldered at one end to the contact 24 and extending substantially half the length of its respective bore 26, and a nonfusible section 32 coupled to the segment 30 and extending the remaining distance through such bore. The fusible segments 30 are preferably constructed of low melting temperature, eutectic material while the nonfusible sections 32 are constructed on an axially twisted ribbon of electrical grade silver or other highly conductive metal. In preferred forms, the width of the ribbon used to construct the nonfusible sections 32 is just slightly less than the diameter of each of the tubular bores 26.

Considering again FIG. 1, it can be seen that the end cap 16 comprises a tubular metal base 34 which telescopically receives one end of the cartridge 18 and is fixedly secured thereto, and an end plug 36 which is releasably threadably coupled with the base 34. A cavity formed in the plug 36 defines a chamber 38 which is in sealed fluid communication with the lowermost ends of the bores 26 as viewed in FIG. 1. The chamber 38 is normally in fluid communication with the surrounding oil medium through a vent hole 40 formed in the plug 36. The importance of the chamber 38 and its relation to vent hole 40 will be more fully explained hereinafter.

As best shown in FIG. 1, end cap 14 comprises a tubular base 42 which receives the upper end of the member 18 and is securedly attached thereto, while a trap member 44 is adapted to be releasably attached to the base 42 by set screws 46 and has a threaded male member 48 for attaching the fuse 10 to the current limiting fuse 12. The trap member 44 is generally cylindrical and has a central vent chamber 50 formed therein. The chamber 50 is provided with a series of radially extending vent slots 52 and is normally in fluid communication with the upper ends of the bores 26. When properly mated, the base 42 and member 44 clamp terminal ends 54 of the nonfusible segments 32 in the manner shown for example in FIG. 1. By this arrangement, there is formed a positive electrical connection between the elements 28 and end cap 14.

In a similar manner, the base 34 and plug 36 of end cap 16 clampingly engage a flange 56 on the metal contact 24 to establish a positive electrical connection at the other end of the fuse 10. Considering further this end of the fuse and referring specifically to FIG. 1, it can be seen that a check valve 58 is disposed within the chamber 38. The valve 58 includes a synthetic resin slide member 60 preferably of an organic polymer having a seating surface 62 adapted to engage the tapered bottom 64 of the chamber 38 to seal the latter against venting through the hole 40 when the valve 58 is in closed position. A coil spring 66 holds the valve 58 in the open position except under certain conditions to be amplified hereinbelow.

Figure 4:
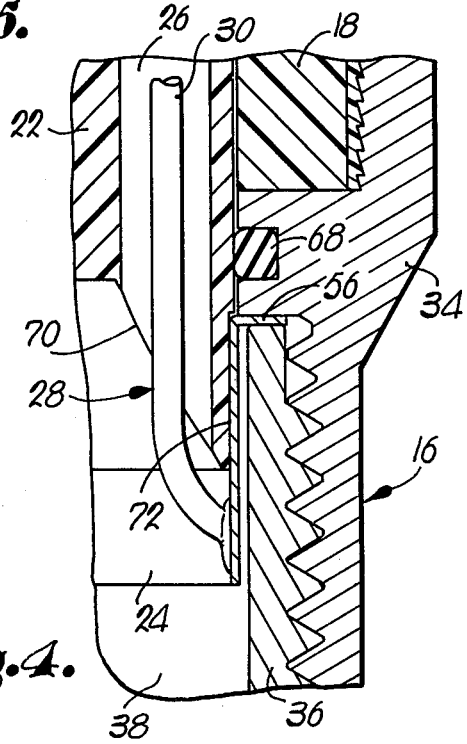
FIG. 4 is an enlarged, fragmentary, cross-sectional view showing details of construction of the seals between the fuse core and the lower end terminal.

An important feature of the present invention is the seal between the insert member 22 and the end cap 16. In this regard, an O-ring seal 68 is disposed between the member 22 and base 34 as shown in detail in FIG. 4. This seal is designed to preclude leakage of gases from the bores 26 and chamber 38 to the interface between the insert member 22 and the cartridge 18. As a backup to the O-ring seal 68, there is provided a metal-to-metal seal at the flange 56 by virtue of its clamped position between the base 34 and the end plug 36 thus precluding gas leadkage from the chamber 38 along a path outside the seal surface. A similar backup seal to prevent leakage along a path inside the taper terminal 24 is provided in the form of a tapered section 70 at the outermost circumference of the member 22 adjacent its telescopic interface with the contact 24 such that the natural resiliency of the member 22 creates a compression seal at this interface (identified generally by the number 72)

when positive pressure is experienced in the chamber 38.

Figure 6:
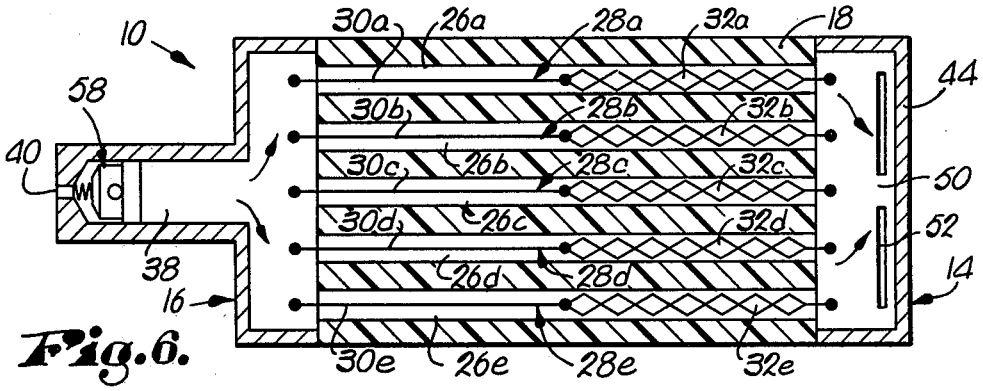
FIG. 6 is a cross-sectional schematic view of the fuse under normal operating conditions.

Referring now to FIGS. 6–9, the operation of fuse 10 is shown in schematic sequence. It is to be understood that for clarity all bores have been shown as being in the same plane though in actuality the bores are arranged symmetrically in a cylindrical pattern involving multiple planes as shown for example in FIG. 2. Under normal operating conditions, the fuse is disposed as shown in FIG. 6 wherein the valve 58 is in the open position and oil flows by natural convection through the bores 26 from the chamber 38 to the vent chamber 50 as represented by the solid arrows. This oil flow is, of course, required to dissipate heat generated in the fuse elements 28.

Figure 7:
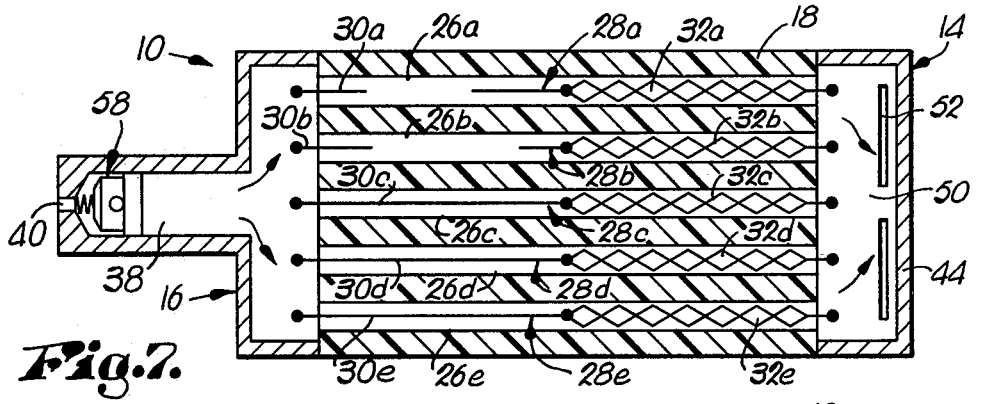
FIG. 7 is a schematic view as in FIG. 6 showing initial melting of certain of the fuse elements upon experiencing a fault current across the fuse.

FIG. 7 shows the fuse 10 shortly after a fault or overload current has been encountered in the distribution circuit. Initially, it may well be that the fusible segments 30*a* and 30*b* of fuse elements 28*a* and 28*b* respectively have sequentially melted in response to the fault current, while the full current load is being conducted by the remaining fuse elements 28*c*, 28*d* and 28*e* in electrical parallel relationship thereto. No arcing occurs in the fuse bores where the fuse link elements have melted because the overload or fault current is carried by the remaining fuse link elements. Note at this point that the valve 58 is still in the open position and that oil continues to flow through the bores 26.

Figure 8:
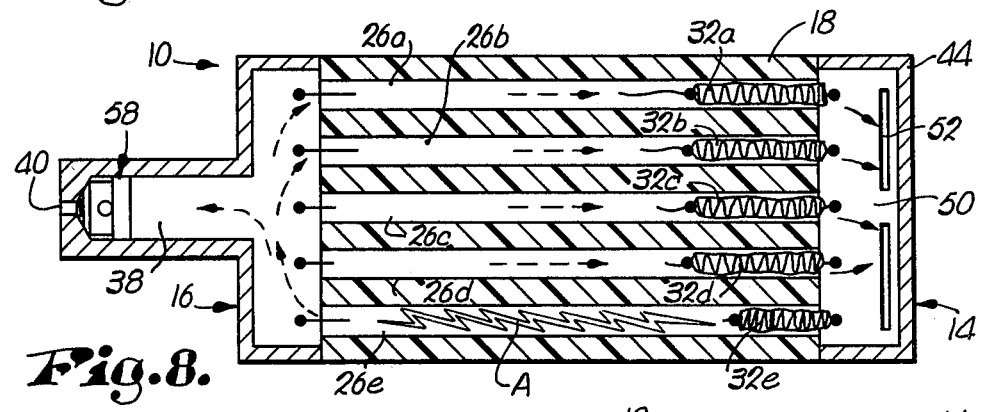
FIG. 8 is a fragmentary view as in FIG. 6 showing all of the fuse elements severed and an arc formed in the bore of the last to melt fuse.

Referring now to FIG. 8, it is assumed that all of the fusible segments 30 have melted and an arc (identified by the letter A) has formed by melting and vaporization of the last to melt fuse element in bore 26*e*. The arc A vaporizes the oil in the bore 26*e* creating high pressure deionizing gas which vents not only in the direction by the broken line arrows toward chamber 38, but also in the opposite direction toward chamber 50 which first collapses the non-fusible ribbon section 32*e* and then ejects such collapsed ribbon from bore 26*e* into chamber 50. It is important to note at this point that gas directed into chamber 38 from bore 26*e* (which it is to be appreciated will in a particular case be the bore in which arc A is generated) and hence the pressure build-up in chamber 38 causes the valve 58 to close thereby sealing the vent hole 40 and precluding venting of the chamber 38 by this means. Hence, all of the gas flow created by the arc A which enters chamber 38 must vent unidirectionally through all of the remaining bores 26 in which an arc did not occur into the vent bore 50 and ultimately out the vent slots 52. This unidirectional venting of all of the non-arcing bores also causes the non-fusible sections 32 therein to be collapsed and forcibly discharged into chamber 50.

Figure 9:
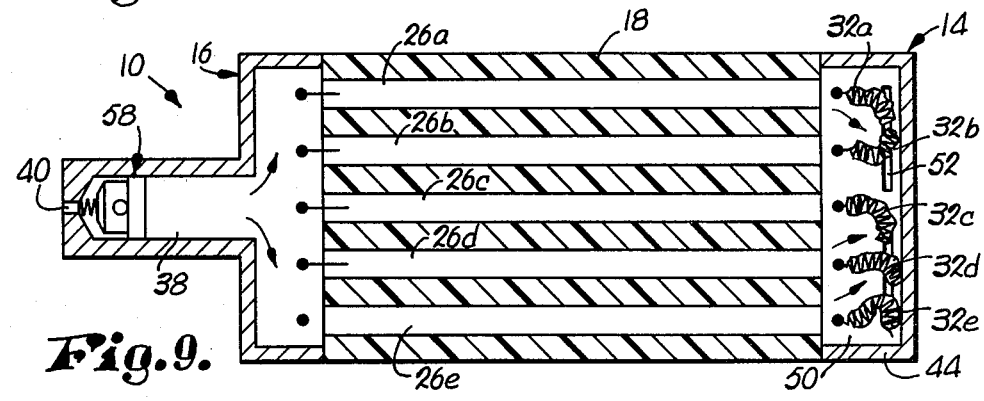
FIG. 9 is a schematic as in FIG. 6 showing the fuse after the fault current has been interrupted.

FIG. 9 schematically illustrates the condition of the fuse once the arc A has been extinguished and the fault current completely interrupted by the fuse 10. Note that the nonfusible segments 32 have all been ejected from their respective bores 26 and deposited in the vent chamber 50. These segments 32 are precluded from escaping into the oil reservoir of the protected transformer by the unique construction of the vent slots and the trap member 44. The valve 58 is now again allowed to open such that oil is permitted to flow through the bores 26 thereby reducing the likelihood of arc restrikes in subsequent normal frequency recovery voltage cycles. Of course, during generation of the high pressure gases and the unidirectional venting of the non-arcing bores, leakage of gases from the chamber 38 into the interface between the tubular cartridge 18 and the insert member 22 is precluded by the presence of the O-ring seal 68 and backup seals at the flange 56 and the interface 72.

The spiral configuration of non-melting sections 32 of fuse element 28 is an important factor in the improved operational results obtained from use of fuses 10. The twisted configuration presents little or no increased resistance to oil flow through a bore during normal flow of load current. However, upon arcing the pressure rise in the bores is very rapid. Before the oil filling the bores can vent into chamber 50, the oil is given an angular acceleration by the non-melting twisted sections. These twists create a higher pressure drop causing the non-fusible sections to exit the bores more quickly than if the same sections were untwisted.

INDUSTRIAL APPLICABILITY

The preferred use of the present invention has been fully explained hereinabove. Essentially the principles of the present invention may be applied to virtually any oil expulsion fuse design, though primarily this improvement is intended for use in multiple-bored expulsion fuses where higher ampacity is desired.

It is clear from the foregoing that the present invention offers a significant improvement over devices heretofore available in the art. At the present time, there simply does not exist a higher ampacity oil expulsion fuse which is capable of reliably clearing the fault currents likely to be encountered in high voltage distribution systems of the 25 to 35 KV range.

We claim:

1. An expulsion fuse adapted for oil immersion and operable to interrupt low range fault and overload currents in a high voltage electrical distribution circuit, said fuse comprising:

a pair of spaced, electrically conductive terminals adapted to be interposed in said circuit;

an elongated dielectric member spanning the distance between said terminals;

structure defining multiple, discrete bores in said member and extending the full length thereof, said bores being vented at each end of said member to establish a fluid flow path through each bore;

a conductive element disposed within each of said bores and electrically coupled to said terminals for defining a plurality of electrically parallel current paths therebetween, said elements each including a fusible segment, meltable upon experiencing a current of a predetermined level, for the breaking of said electrical circuit by melting of said segments when the segments are subjected to a fault current above said predetermined level with consequent arc generation and vaporization of said oil; and means for directing at least a portion of the gases derived from said oil vaporization through the at least certain of said bores for clearing the same of conductive material.

2. The fuse of claim 1, there being cap defining structure at one end of said member, said structure having a chamber in sealed fluid communication with said bores and provided with a vent hole communicating with the surrounding oil medium, said gas directing means including means shiftably mounted on said structure for closing the vent hole upon buildup of gas pressure in the chamber by said gases derived from said oil vaporization.

3. The fuse of claim 2, said vent hole closing means comprising a one-way valve within said chamber.

4. The fuse of claim 3, there being means forcing the valve away from its closed position under a spring bias requiring a predetermined pressure thereagainst to effect closing of the valve.

5. The fuse of claim 4; and a nonconductive tubular casing complementally receiving said member and extending substantially the full length thereof.

6. The fuse of claim 5, there being a seal assembly between sad cap structure and said member to preclude gas leakage from said chamber into the interface between said member and said casing.

7. The fuse of claim 6, said seal assembly including an O-ring seal between the cap structure and said member.

8. The fuse of claim 7, said one end of said member being provided with a coaxial, tubular metal contact having an external annular flange, said seal assembly including means forming a compression seal with said flange.

9. The fuse of claim 8, said one end of the member being telescopically received within said contact, said seal assembly including a seal between said member and said contact at said one end.

10. The fuse of claim 1, said conductive elements each having a non-fusible section.

11. The fuse of claim 10, said non-fusible sections being remote from said one end of the member.

12. The fuse of claim 11, said bores all begin generally cylindrical, each of said non-fusible sections comprising an elongated, axially twisted metal ribbon having a width approximately equal to the diameter of a respective bore.

13. The fuse of claim 12, the length of said sections being greater than 25% of the length of said bores.

14. The fuse of claim 11, the other end of said member being provided with an apertured trap in communication with said bores and the surrounding oil medium for receiving said non-conductive sections upon operation of the fuse to preclude discharge of said sections into the oil around the fuse.

15. The fuse of claim 1 wherein is provided means replaceably supporting the member and said elements in electrically conductive disposition between said terminals and operable to permit ready replacement of the member and said elements as a unit upon functioning of the fuse to interrupt a fault or overload current.

* * * * *